US006418842B1

(12) United States Patent
Justis, Jr.

(10) Patent No.: US 6,418,842 B1
(45) Date of Patent: Jul. 16, 2002

(54) PLASTIC BOTTLE RESTRICTING DEVICE

(76) Inventor: Robert Justis, Jr., 3021 Spruce Ave., Egg Harbor Township, NJ (US) 08234

( * ) Notice: Subject to any disclaimer, the term of this patent is extended or adjusted under 35 U.S.C. 154(b) by 0 days.

(21) Appl. No.: 09/566,149

(22) Filed: May 5, 2000

(51) Int. Cl.[7] ..... B30B 7/04
(52) U.S. Cl. ..... 100/232; 100/264
(58) Field of Search ..... 100/232, 264

(56) References Cited

U.S. PATENT DOCUMENTS 4,492,313 A 1/1985 Touzani ..... 215/1
5,233,917 A * 8/1993 Handzlik ..... 100/232
5,265,530 A * 11/1993 Perhacs et al. ..... 100/233
5,370,262 A 12/1994 Kato ..... 220/731
5,802,968 A * 9/1998 Kirschner et al. ..... 100/233

* cited by examiner

*Primary Examiner*—Allen Ostrager
*Assistant Examiner*—William Hong
(74) *Attorney, Agent, or Firm*—Goldstein & Lavas, P.C.

(57) ABSTRACT

A plastic bottle restricting device including a circular sleeve having an open upper end and an open lower end. The circular sleeve is dimensioned for receiving a plastic bottle. The circular sleeve has a pair of threaded apertures therethrough. A pair of screws extend through the pair of diametrically opposed threaded apertures of the circular sleeve. The pair of screws each have an inner end and an outer end. A pair of arcuate plates are positioned within the circular sleeve. The arcuate plates each have an inner surface and an outer surface. The inner surfaces are positionable against the plastic bottle. The outer surfaces are secured to the inner ends of the pair of screws whereby tightening of the screws will squeeze the plastic bottle between the arcuate plates.

5 Claims, 2 Drawing Sheets

PLASTIC BOTTLE RESTRICTING DEVICE

BACKGROUND OF THE INVENTION

The present invention relates to a plastic bottle restricting device and more particularly pertains to forcing air out of a plastic bottle to prevent a carbonated beverage from becoming flat.

The use of receptacle devices is known in the prior art. More specifically, receptacle devices heretofore devised and utilized for the purpose of containing beverages are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,492,313 to Tousani discloses a foldable plastic soda bottle comprised of a circular bellow capable of collapsing as the content is used to prevent carbon dioxide from escaping. U.S. Pat. No. 5,370,262 to Kato discloses an auxiliary lid for a beverage receptacle capable of preventing bubbles from spouting out.

While these devices fulfill their respective, particular objective and requirements, the aforementioned patents do not describe a plastic bottle restricting device for forcing air out of a plastic bottle to prevent a carbonated beverage from becoming flat.

In this respect, the plastic bottle restricting device according to the present invention substantially departs from the conventional concepts and designs of the prior art, and in doing so provides an apparatus primarily developed for the purpose of forcing air out of a plastic bottle to prevent a carbonated beverage from becoming flat.

Therefore, it can be appreciated that there exists a continuing need for a new and improved plastic bottle restricting device which can be used for forcing air out of a plastic bottle to prevent a carbonated beverage from becoming flat. In this regard, the present invention substantially fulfills this need.

SUMMARY OF THE INVENTION

In the view of the foregoing disadvantages inherent in the known types of receptacle devices now present in the prior art, the present invention provides an improved plastic bottle restricting device. As such, the general purpose of the present invention, which will be described subsequently in greater detail, is to provide a new and improved plastic bottle restricting device which has all the advantages of the prior art and none of the disadvantages.

To attain this, the present invention essentially comprises a circular sleeve having an open upper end and an open lower end. The circular sleeve is dimensioned for receiving a plastic bottle. The circular sleeve has a pair of diametrically opposed threaded apertures therethrough intermediate the open upper and lower ends thereof. A pair of screws extend through the pair of diametrically opposed threaded apertures of the circular sleeve. The pair of screws each have an inner end and an outer end. The outer ends have a turning handle secured thereto. A pair of arcuate plates are positioned within the circular sleeve. The arcuate plates each have an inner surface and an outer surface. The inner surfaces are positionable against the plastic bottle. The outer surfaces are secured to the inner ends of the pair of screws whereby tightening of the screws will squeeze the plastic bottle between the arcuate plates.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved plastic bottle restricting device which has all the advantages of the prior art receptacle devices and none of the disadvantages.

It is another object of the present invention to provide a new and improved plastic bottle restricting device which may be easily and efficiently manufactured and marketed.

It is a further object of the present invention to provide a new and improved plastic bottle restricting device which is of durable and reliable construction.

An even further object of the present invention is to provide a new and improved plastic bottle restricting device which is susceptible of a low cost of manufacture with regard to both materials and labor, and which accordingly is then susceptible of low prices of sale to the consuming public, thereby making such a plastic bottle restricting device economically available to the buying public.

Even still another object of the present invention is to provide a new and improved plastic bottle restricting device for forcing air out of a plastic bottle to prevent a carbonated beverage from becoming flat.

Lastly, it is an object of the present invention to provide a new and improved plastic bottle restricting device including a circular sleeve having an open upper end and an open lower end. The circular sleeve is dimensioned for receiving a plastic bottle. The circular sleeve has a pair of threaded apertures therethrough. A pair of screws extend through the pair of diametrically opposed threaded apertures of the circular sleeve. The pair of screws each have an inner end and an outer end. A pair of arcuate plates are positioned within the circular sleeve. The arcuate plates each have an inner surface and an outer surface. The inner surfaces are positionable against the plastic bottle. The outer surfaces are secured to the inner ends of the pair of screws whereby tightening of the screws will squeeze the plastic bottle between the arcuate plates.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
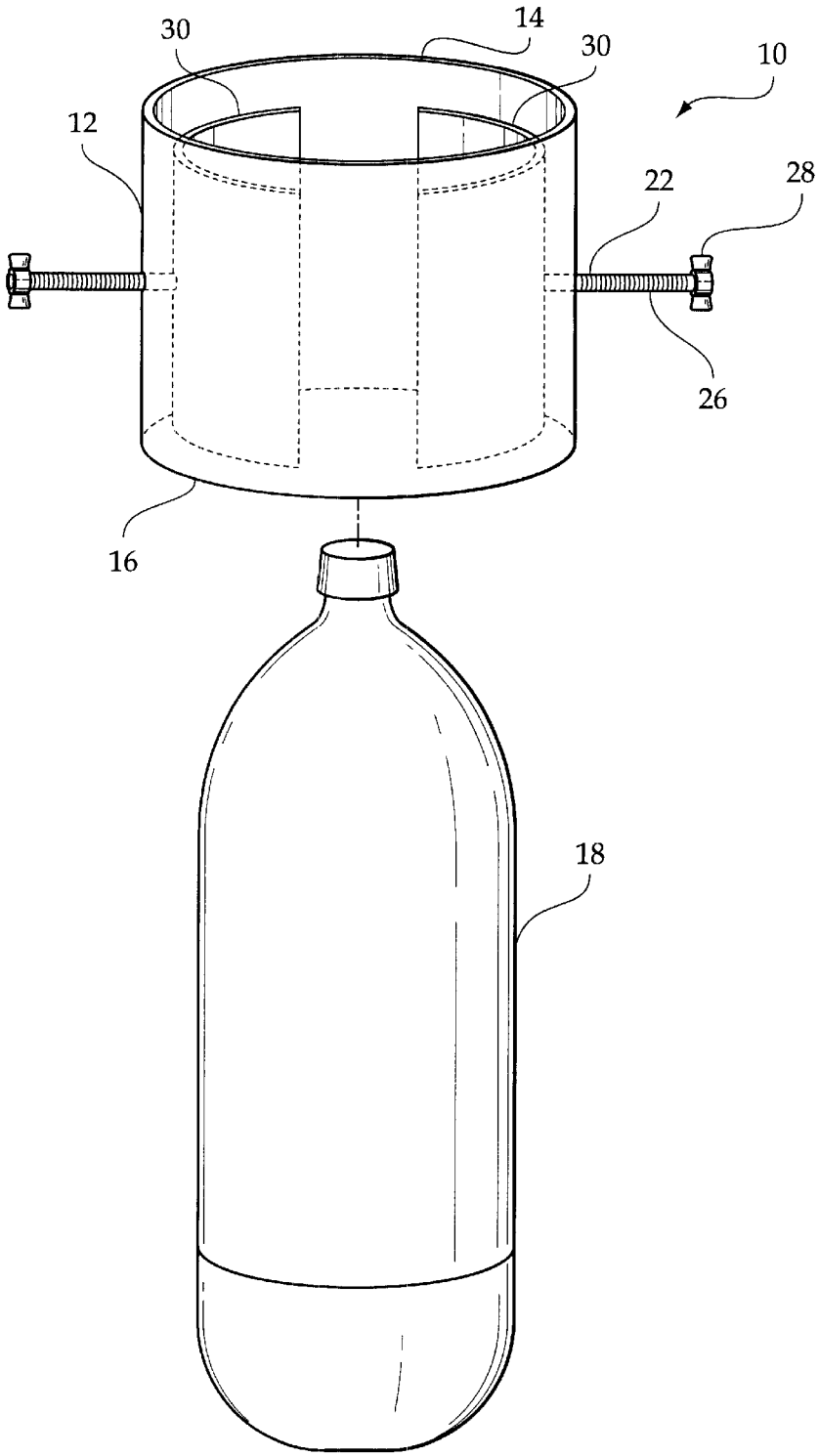
FIG. 1 is a perspective view of the preferred embodiment of the plastic bottle restricting device constructed in accordance with the principles of the present invention.
Figure 3:
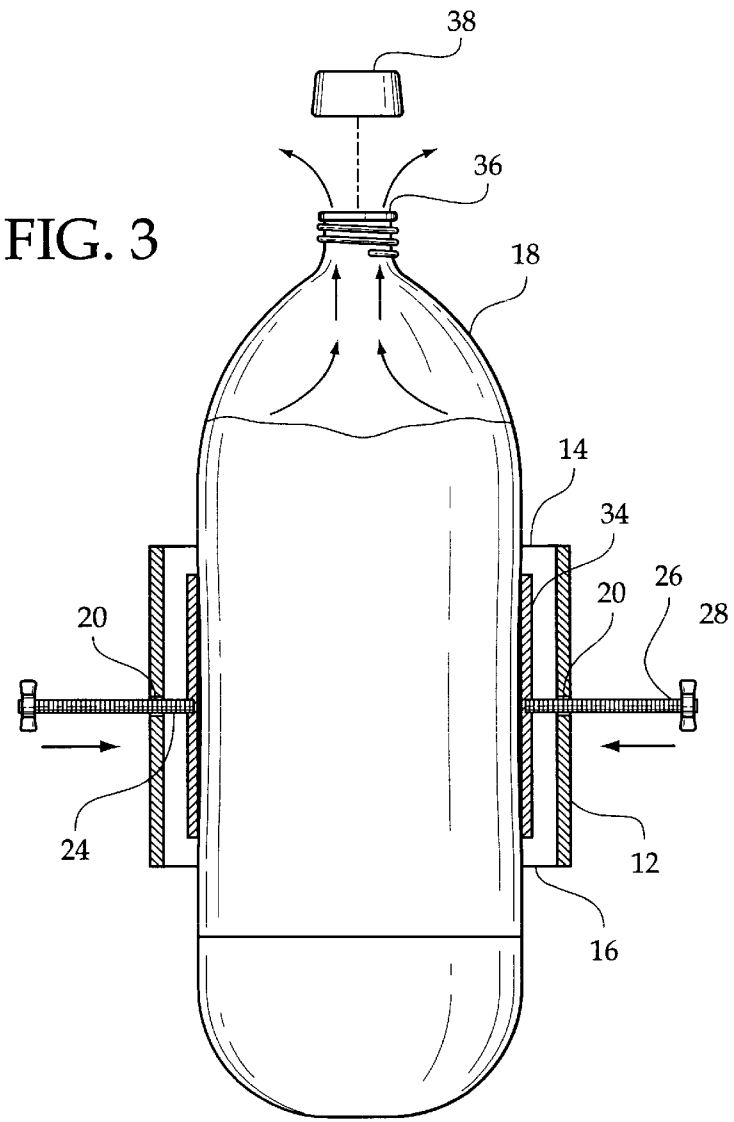
FIG. 3 is a side view of the present invention illustrated in use.
Figure 2:
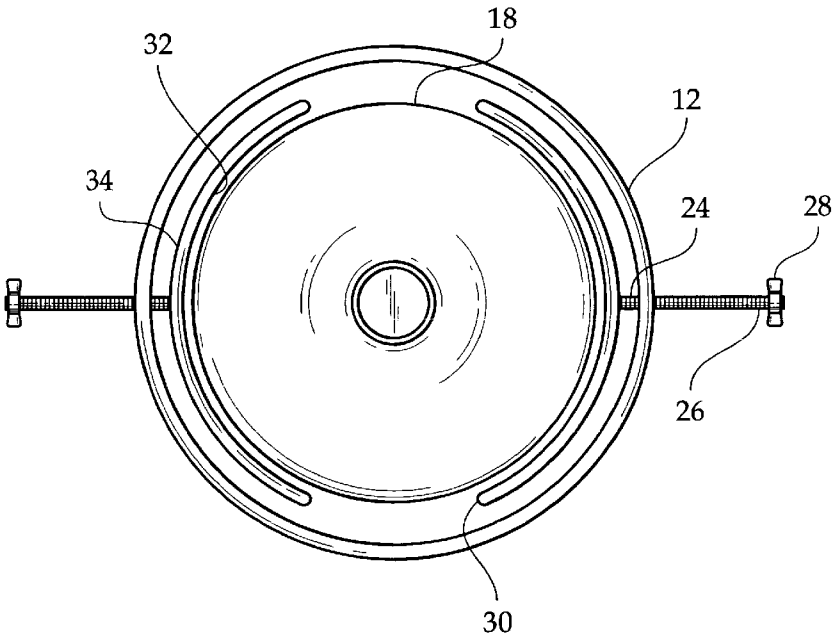
FIG. 2 is a top plan view of the present invention.

With reference now to the drawings, and in particular, to FIGS. 1 through 3 thereof, the preferred embodiment of the new and improved plastic bottle restricting device embodying the principles and concepts of the present invention and generally designated by the reference number 10 will be described.

Specifically, it will be noted in the various Figures that the device relates to a plastic bottle restricting device for forcing air out of a plastic bottle to prevent a carbonated beverage from becoming flat. In its broadest context, the device consists of a circular sleeve, a pair of screws, and a pair of arcuate plates. Such components are individually configured and correlated with respect to each other so as to attain the desired objective.

The circular sleeve 12 has an open upper end 14 and an open lower end 16. The circular sleeve 12 is dimensioned for receiving a plastic bottle 18. Note FIG. 1. The circular sleeve 12 has a pair of diametrically opposed threaded apertures 20 therethrough intermediate the open upper and lower ends 14,16 thereof. The size of the circular sleeve 12 will depend on the size of the plastic bottle 18 being used. Typically, the circular sleeve 12 will be used on two and three liter plastic bottles because smaller bottles tend to be entirely consumed after being initially opened.

The pair of screws 22 extend through the pair of diametrically opposed threaded apertures 20 of the circular sleeve 12. The pair of screws 22 each have an inner end 24 and an outer end 26. The outer ends 26 have a turning handle 28 secured thereto.

The pair of arcuate plates 30 are positioned within the circular sleeve 12. The arcuate plates 30 each have an inner surface 32 and an outer surface 34. The inner surfaces 32 are positionable against the plastic bottle 18. The outer surfaces 34 are secured to the inner ends 24 of the pair of screws 22 whereby tightening of the screws 22 will squeeze the plastic bottle 18 between the arcuate plates 30. Note FIG. 3.

In use, once the plastic bottle 18 has been opened and some of it's contents poured out, the circular sleeve 12 is positioned around the plastic bottle 18. The screws 22 are tightened so that arcuate plates 30 squeeze against the plastic bottle 18. This will force the remaining contents of the bottle 18 upwardly thereby forcing any remaining air out of the open upper end 36 of the bottle 18. Once the air has been removed, the cap 38 can be tightened on the open upper end 36 and the device 10 can be removed by loosening the pair of screws 22. Thus, the contents of the bottle 18, which are carbonated, will not become flat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A plastic bottle restricting device for forcing air out of a plastic bottle to prevent a carbonated beverage from becoming flat comprising, in combination:

a circular sleeve having an open upper end and an open lower end, the circular sleeve being dimensioned for receiving a plastic bottle, the circular sleeve having a pair of diametrically opposed threaded apertures therethrough intermediate the open upper and lower ends thereof;

a pair of screws extending through the pair of diametrically opposed threaded apertures of the circular sleeve, the pair of screws each having an inner end and an outer end, the outer ends having a turning handle secured thereto;

a pair of arcuate plates positioned within the circular sleeve, the arcuate plates each having an inner surface and an outer surface, the inner surfaces being positionable against the plastic bottle, the outer surfaces being secured to the inner ends of the pair of screws whereby tightening of the screws will squeeze the plastic bottle between the arcuate plates.

2. A plastic bottle restricting device for forcing air out of a plastic bottle to prevent a carbonated beverage from becoming flat comprising, in combination:

a circular sleeve having an open upper end and an open lower end, the circular sleeve being dimensioned for receiving a plastic bottle, the circular sleeve having a pair of threaded apertures therethrough;

a pair of screws extending through the pair of threaded apertures of the circular sleeve, the pair of screws each having an inner end and an outer end;

a pair of arcuate plates positioned within the circular sleeve, the arcuate plates each having an inner surface and an outer surface, the inner surfaces being positionable against the plastic bottle, the outer surfaces being secured to the inner ends of the pair of screws whereby tightening of the screws will squeeze the plastic bottle between the arcuate plates.

3. The plastic bottle restricting device as set forth in claim 2 wherein the pair of threaded apertures of the circular sleeve are diametrically opposed.

4. The plastic bottle restricting device as set forth in claim 2 wherein the pair of threaded apertures of the circular sleeve are disposed intermediate the open upper and lower ends thereof.

5. The plastic bottle restricting device as set forth in claim 2 wherein the outer ends of the pair of screws each have a turning handle secured thereto.

* * * * *